United States Patent [19]

Guignon et al.

[11] 4,144,898

[45] Mar. 20, 1979

[54] HOSE REEL AND JET CLEANING MACHINE

[76] Inventors: John E. Guignon; Helen G. Guignon, both of 12 Chipper Rd., St. Louis, Mo. 63131; John E. Guignon, Jr., 110 High Valley, Chesterfield, Mo. 63107

[21] Appl. No.: 760,179

[22] Filed: Jan. 17, 1977

[51] Int. Cl.[2] ..... B08B 3/02; B08B 9/08

[52] U.S. Cl. ..... 134/113; 134/167 R; 239/197; 239/227

[58] Field of Search ..... 134/167 R, 167 C, 168 R, 134/168 C, 172, 113; 239/186, 197, 227

[56] References Cited

U.S. PATENT DOCUMENTS

| | | | |
|---|---|---|---|
| Re. 28,320 | 1/1975 | Baldwin | 239/227 X |
| 361,474 | 4/1887 | Weygant | 239/197 X |
| 2,181,521 | 11/1939 | Reade | 239/197 X |
| 3,444,869 | 5/1969 | Guignon et al. | 134/167 R |
| 3,477,178 | 11/1969 | Hulbert, Jr. | 134/167 R X |
| 3,645,452 | 2/1972 | Stoeckel et al. | 239/227 |
| 3,791,393 | 2/1974 | Baldwin | 134/167 R |
| 3,895,756 | 7/1975 | Jaeger | 134/167 R X |

FOREIGN PATENT DOCUMENTS

| | | | |
|---|---|---|---|
| 514,256 | 2/1955 | Italy | 239/227 |

*Primary Examiner*—Robert L. Bleutge

[57] ABSTRACT

A tank cleaning machine which comprises a nozzle manifold having one or more nozzles, that can be fed into and retracted from a tank while rotating or oscillating while cleaning fluid is supplied from a hose so that jet cleaning streams are directed to only those areas inside the tank that require cleaning. A very important feature of this device is to be able to clean very long horizontal or high vertical tanks and have the nozzles move along the tank greatly reducing the distance that the jet cleaning streams must travel after leaving the nozzles resulting in greater impact scrubbing action and reducing the breaking up of the stream to give very high efficiency. The travel feature of the nozzle manifold also permits the addition of a mechanical scrubber, or scraper with a trip arm to allow removal of sludge as the manifold is removed from the tank. Several variations of the manifold track can be made, one is telescoping it for easy removal so that the entire machine can be moved from one tank to another if desired. The unique hose reel features allow a compact design and permits automatic programming to the necessary areas only with independent automatic operation of the rotation and travel features.

14 Claims, 17 Drawing Figures

HOSE REEL AND JET CLEANING MACHINE

Those skilled in the art will recognize the foregoing objects and advantages as well as other objects and advantages from consideration of the following description and the accompanying drawings. In the drawings.

Figures 1, 2, 3, 15, 16, 17:
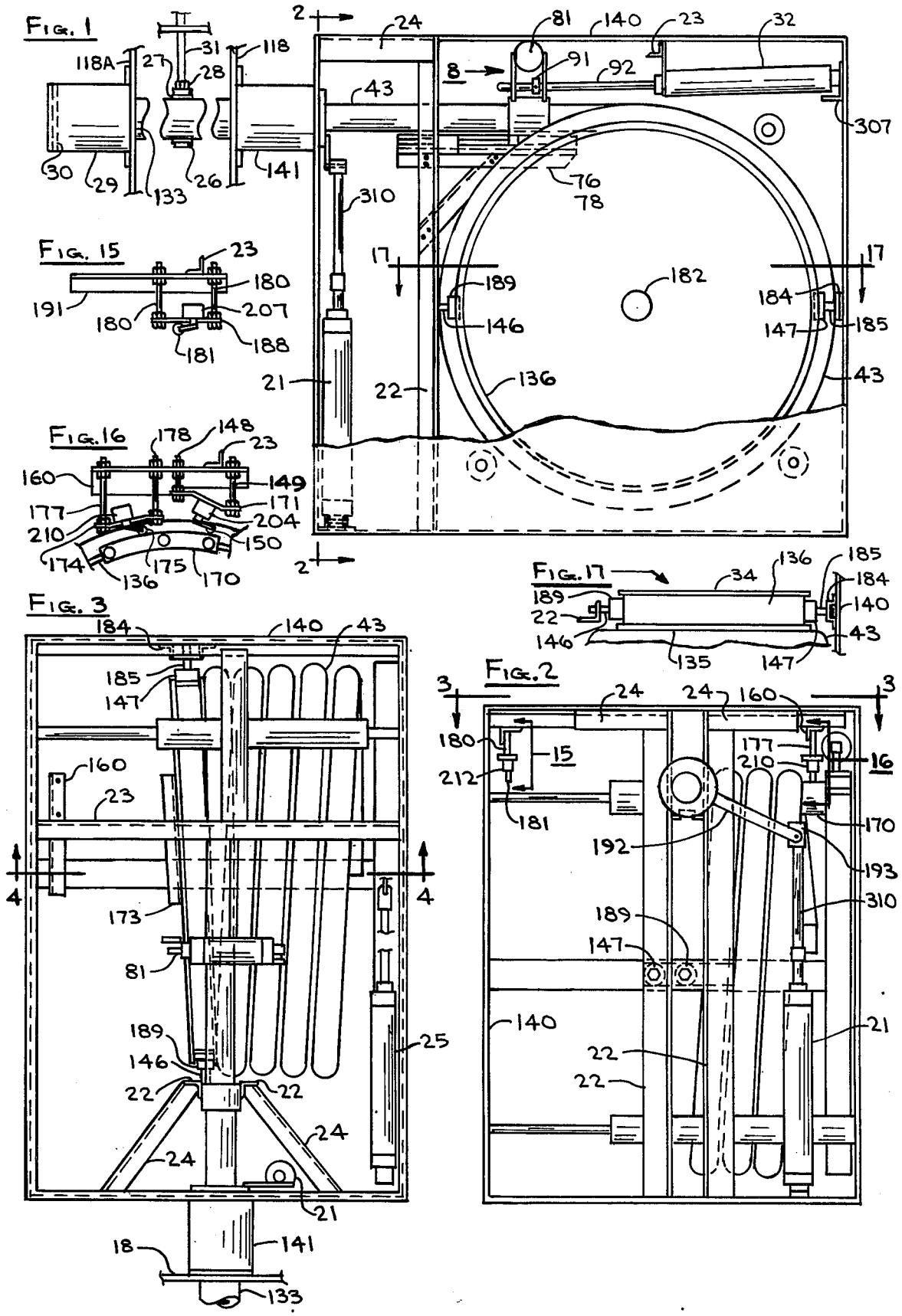
FIG. 1 shows a side view for use with a horizontal tank, parts of the tank, hose, nozzle manifold, track, track bearings, and hose reel location in the housing.
FIG. 2 shows the same general parts inside the housing, but is a view from the tank.
FIG. 3 shows a top view of the same.

FIGS. 15 and 16 has a detail of trip cam and lever arms for the automatic reversing and shut off valves.

FIG. 17 shows top view detail of part of the reel showing the channel type of screw wrap around the circumference of the reel to hold the hose in place and to mesh with the wheels that in turn force the reel axially as it is turned.

Figure 10:
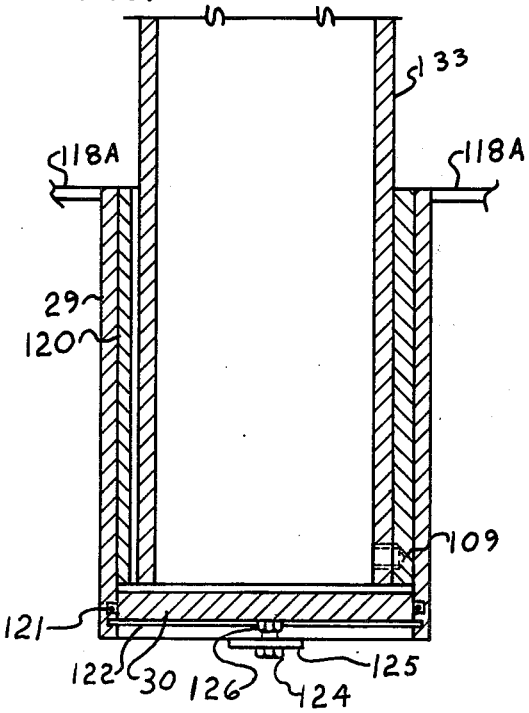
FIG. 10 is a cross section of a track bearing at the end opposite to the entrance into the tank.
Figure 9:
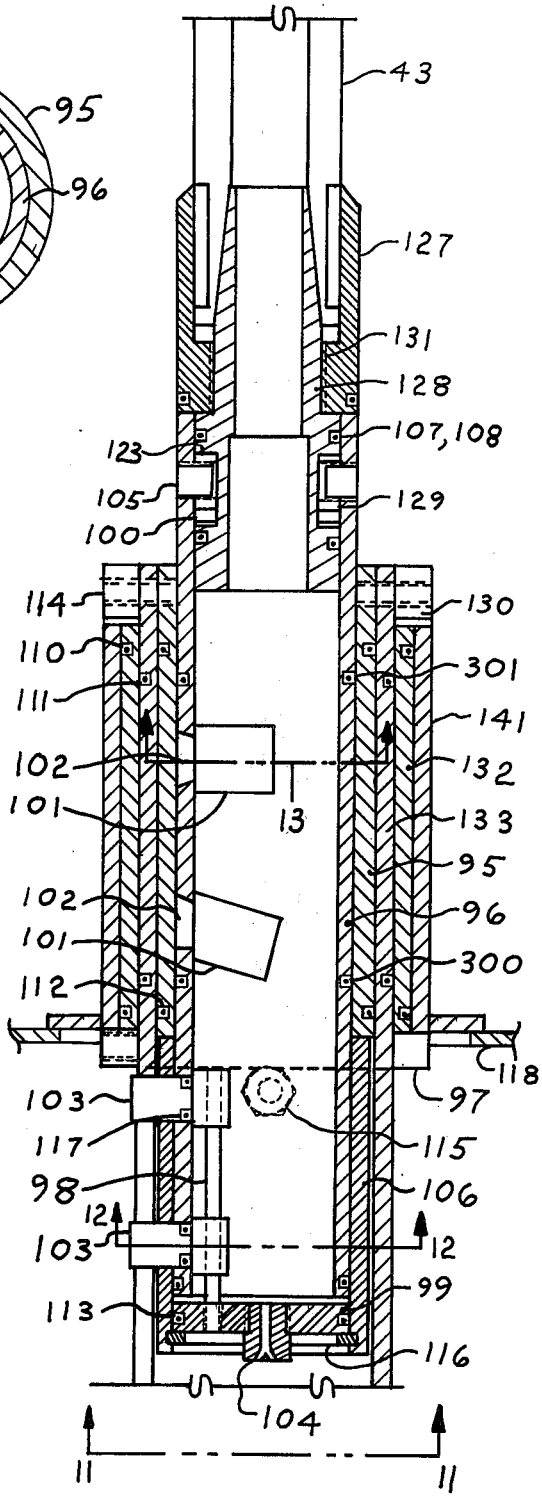
FIG. 9 is a cross section of the nozzle manifold, the bearings for the track and various seals. This shows only one of several ways of attaching the machine to the tank.

In the figures part 140 is the box type of housing that supports the hose reel stationary center shaft and the other stationary parts inside the box. FIGS. 1, 3, and 9 show the tank wall 118 to which the front bearing housing 141 for the track is attached. In these figures a slotted pipe 133 is shown as one means of a track that guides the nozzle manifold 96 and also supports the hose 43 while it is inside the tank. FIGS. 1 and 10 show the rear bearing support 29 which houses sleeve bearing 120. The tank walls are show 118 for the front, 118A for the rear and **118*b* for the top. FIG. 1 has a possible center support 28 and 31 and bearing 27** for a very long tank.

Track 133 provides a means to rotate the nozzle manifold 96 thru guide pins 103 that move along the slot 133A that runs the length of the track that is inside the tank. The track in bearing 132 which is supported by bearing housing 141 is not slotted so that o-rings will seal. The track supports the hose 43 as it moves inside the tank. Hose 43 is attached to nozzle manifold 96 with outer coupling 127 and inner part 128 with female and male threads respectively.

Part 128 has a circular slot 123 that allows retainer 129, which is split, to be held in place with screws 105 that attach to the nozzle manifold manifold 96 and allows it to rotate. A split thrust bearing 100 allows the nozzle manifold to swivel around the hose axis. Cylinder 21 operates the slotted pipe track thru crank arm 192 which is attached to part 133 with ring 130 and bolts 114.

Figure 13:
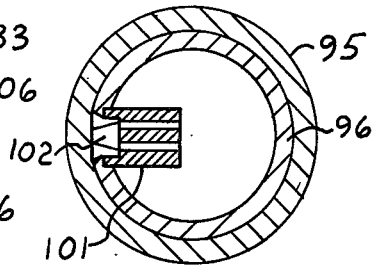

FIGS. 9 and 13 show nozzles 102 and nozzle straightners 101 located inside the nozzle manifold 96 either at right angle or less to the hose travel axis. When the nozzles are outside the tank as shown in FIG. 9 sealing is done with seals 300 and 301 on the outside of the nozzle manifold, and to part 96 which is a bushing inside the slotted pipe track 133. Front bearing sleeve 132 turns in housing 141 and has seals 110 and 111. Another seal shown is 112.

FIG. 10 has a rear bearing cap 30 and seal 121 with retainer ring 122, and nut 124 and plate 125 to hold the cap in place. Rear bearing 120 is attached to the track 133 with bolt 109.

Front cleaning nozzle 104 in nozzle manifold cap 99 cleans the inside of the pipe 133 as the nozzle manifold moves along the track. Cap 99 is held in place with retainer ring 116 and sleeve 106 is held onto the nozzle manifold 96 by pins 103. Rod 98 is attached to cap 99 to hold pins 103 in place. Seals 117 are provided for the pin openings.

Figure 11:
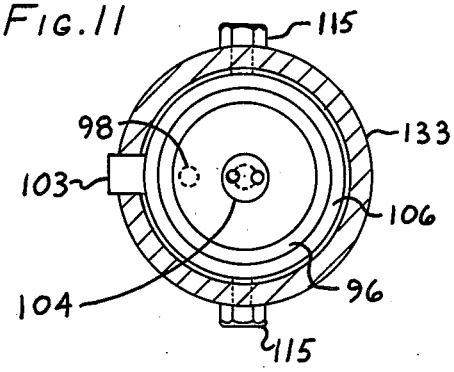
FIG. 11 shows the axial thrust bearing for the track.

Bolts 115 on ring 97 FIG. 11 provide a thrust bearing to hold the track 133 from moving axially out of the tank and bolt 114 and ring 130 hold the track from moving into the tank.

Figures 4, 5:
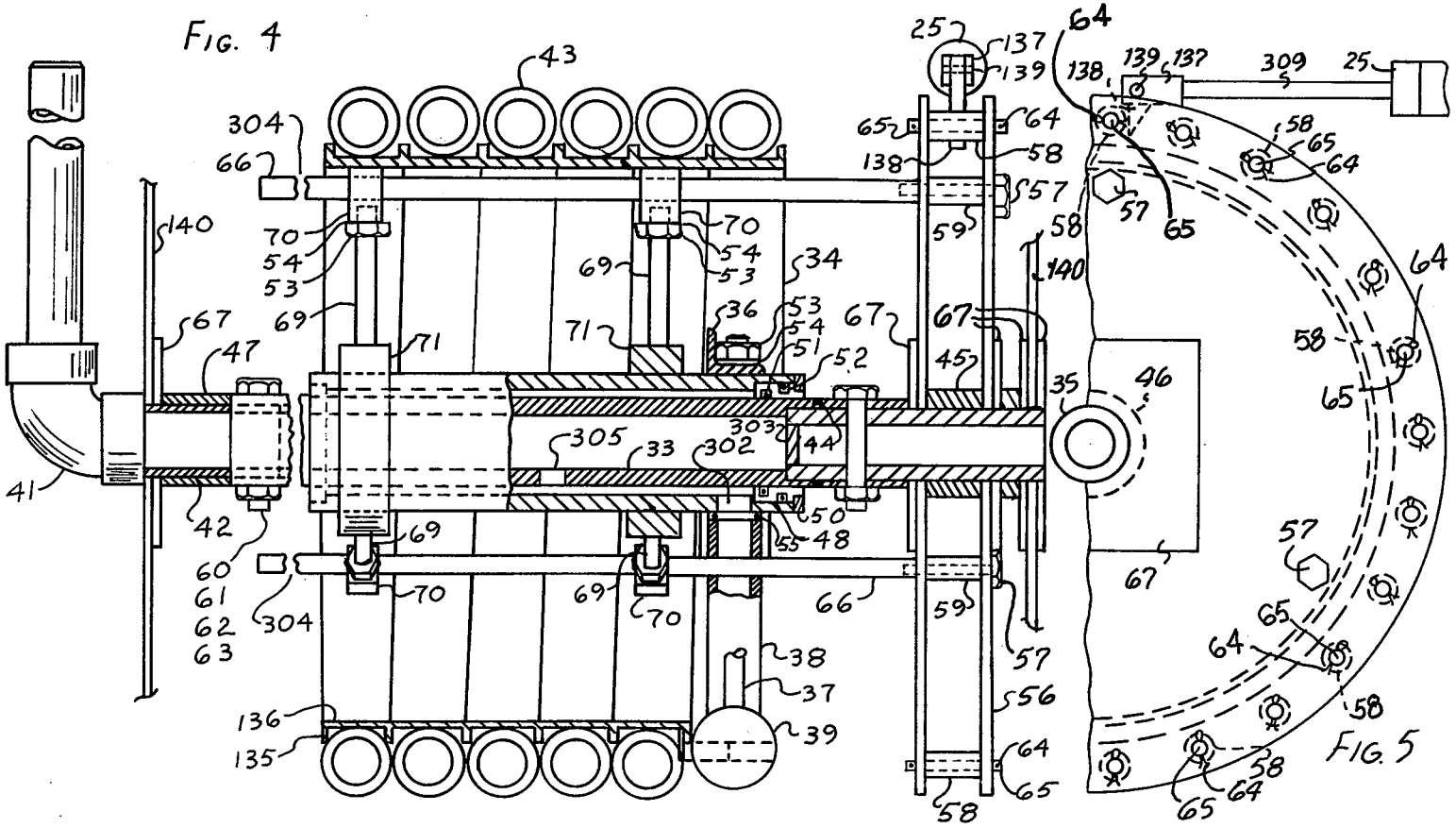
FIG. 4 shows the supply pipe and the flow path of the cleaning fluid from this supply pipe entrance, thru the inside center supply pipe and into the rotating supply manifold, then into the hose and a cross section of the reel. Detail of the wind up or drive wheel and drive rods are also shown.
FIG. 5 shows more details on the wind wheel.

Supply pipe and elbow 41 on FIG. 4 is for cleaning fluid connection. The fluid then flows thru nipple 42 then into stationary center supply pipe 33 and out hole 305 into supply manifold 72 and out hole 302 into pipe 38 and into hose coupling 39 and 40 and then into hose 43. Also see FIG. 6. The other end of the hose is shown on FIG. 9 and is connected to nozzle manifold 96 with the cleaning fluid then flowing thru straightners 101 and out nozzles 104 and 102.

Center pipe 33 is capped at one end with part 35 and plug 303 in FIG. 4. Bolts, nuts, and washers and seals 60 thru 63 hold pipe 42 to pipe 33 on the fluid entrance end and similar bolting on the opposite end of 33 holds 35 in place. Spacers 46 and 47 with washers 67 hold the pipe 33 in housing to prevent axial movement. FIG. 4 shows axial spacers 45, 46, and 47 and thrust washers 67 at several points against housing 140 all holding center shaft 33 from moving axially.

Figure 6:
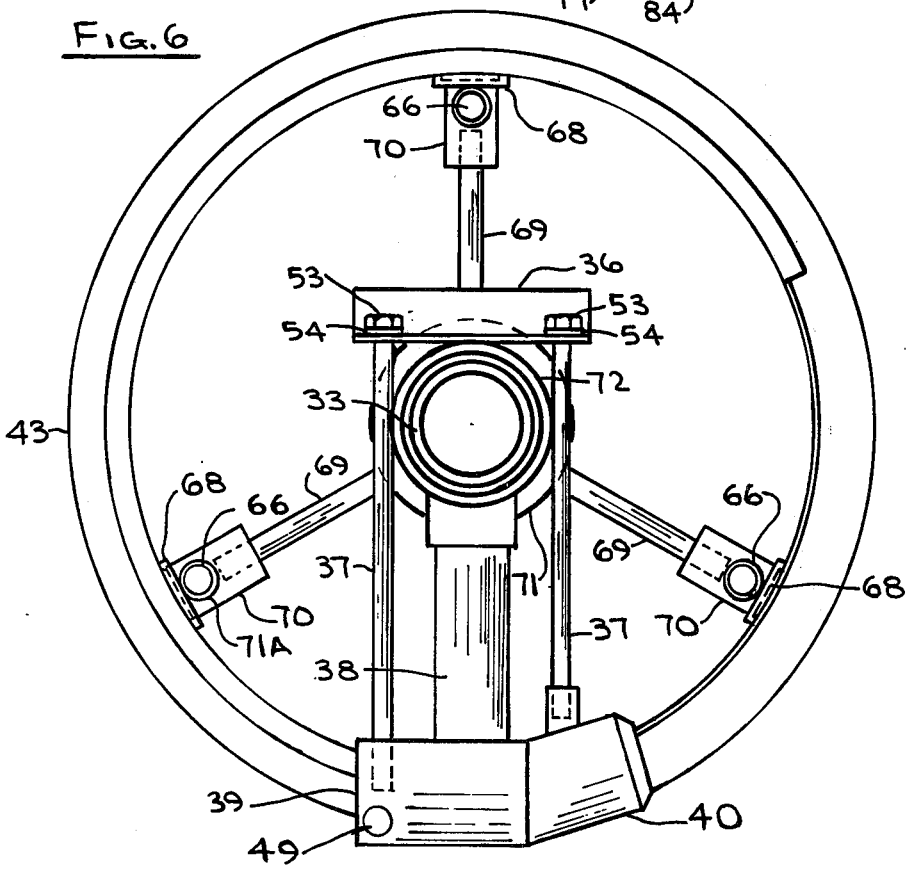
FIG. 6 is a view of the reel from the end or axial.
Figure 12:
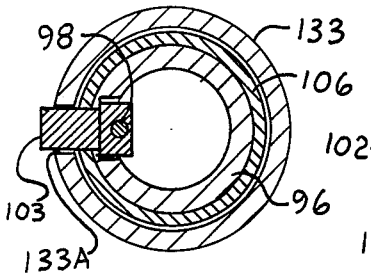
FIGS. 12 and 13 are cross sections thru the nozzle manifold.

The rotating center supply manifold 72 is sealed at each end and rides in bearings 48 which are held in with retainer 50 and sealed with seals 51 and 52. Manifold 72 is attached to reel 136 thru collars 71 and spokes 69 and adjusting nuts and washers 53 and 54 and guides 70 shown on FIG. 4. Guides 70 and hole **71*a* for guide rods 66 transfer the torque from drive wheel assembly 56 to the hose reel 136. FIG. 6 also shows the retainer collars 68 that hold the spoke collars 71 in place. Tie rods 37 with angle 36 and nuts and washers 53 and 54 hold the hose coupling 39 to supply manifold 72. Hose reel 136 and supply manifold rotate and moves axially as a unit slidding on rods 66. Rods 66 are attached to drive weel 56 with bolts 57 and spacers 58** shown on 4 and 5.

Space 304 between broken lines on FIG. 4 indicates pipe 33 is about twice as long as shown to allow for the manifold 72 and reel to move axially as the hose is removed from the reel. Rods 66 also have this increased length, as the rods turn with the drive wheel and reel but do not move axially but stays in one place with the drive wheel.

The cylindrical part of the hose reel 136 has a spiral plate at right angles wound and welded to provide a large screw with pitch equal to the hose diameter. Rollers 147 and 189 in FIGS. 1, 2, 3, and 17, engage the spiral screw on the reel and force the reel to move axially as it is turned. Wheels 147 and 189 are on shafts that are fixed to housing 140. The exit of the hose from the reel stays in the same place and enters the tank opening always at right angles as the reel is wound or unwound. The wheels act as a fixed nut for the screw part of the reel.

Figure 8:
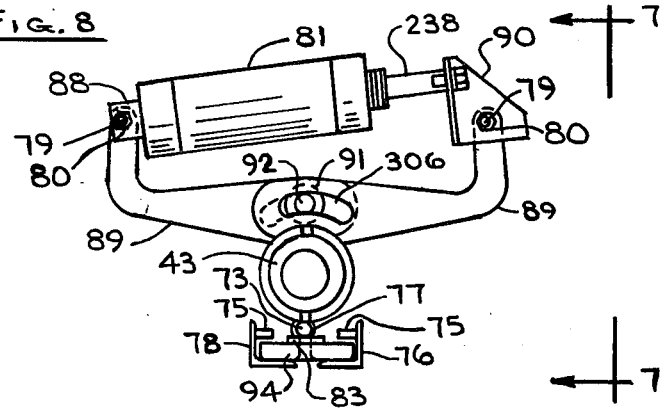
FIG. 8 shows the hose grip detail axially with the hose as it enters the tank.
Figure 7:
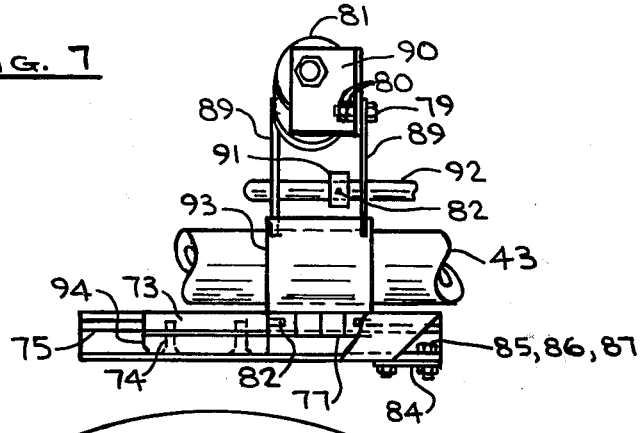
FIG. 7 shows the hose grip at right angle to the hose feed into the tank.

The hose is pulled off the reel with collar 91 on piston rod 92 from cylinder 32 engaging arms 89 thru slot 306 FIGS. 7 and 8. Cylinder 32 is attached to housing 140 thru plate and angle 23 and angle 307 FIG. 1. FIGS. 7 and 8 show hose grip 93 attached to arms 89 with hinge 77 and hinge pin 75. Grip is two parts, each one half of a cylinder with one half attached to one side of the hinge and the other half attached to the other side of the hinge so the grip can close and grip the hose or open and allow the grip to move away from the tank and then close at the end of the outward stroke, and close to grip again. FIG. 8 shows the grip in the closed position, with air to the piston rod side of cylinder 81 thus pulling the grip tight on the hose. At the same time air is supplied to the cylinder 32 so that rod 92 is pushed away from the cylinder 32 and thus feeding the hose off the reel.

Slide shoe 94 is attached to the hinge pin 73 with bolts 74 and moves on support track 76, 78 and 75, with this support track attached to housing 140 thru angle frame 22 and 24.

Figure 14:
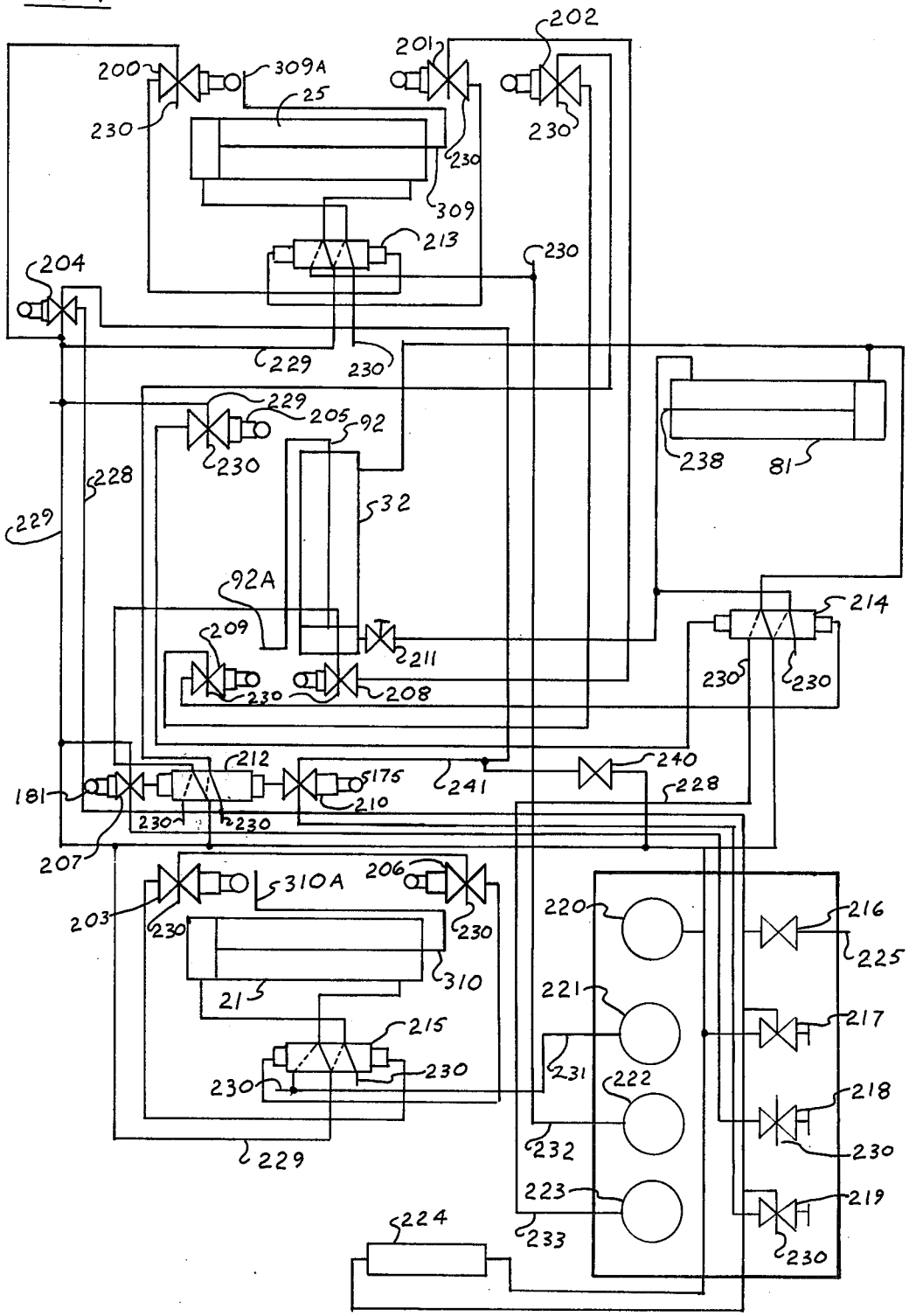
FIG. 14 shows one method of automatic controls.

FIG. 14 is a schmatic drawing for the air flow thru the automatic valves and controls. Some features of this are unique not only to tank cleaning devices, but also to air cylinders. The motive force to the cylinders and valves is air or fluid, without any electrical connections. This air enters at 225 then thru a manual shut-off valve 216 then to automatic shut-off valve 204. This valve 204 is shown on FIG. 14 with all the other valves, and 204 is also shown on FIG. 16 with the mechanical lever that rides on cam surface 170 which is attached to reel 136 so that when the hose is fully retracted from the tank cam surface 170 will operate lever 150 on valve 204 and shut down the machine. Just prior to this point of travel of the hose and reel cam 170 trips lever 175 on valve 210, reversing the hose travel only if hand valve 240 is open or valve 204 is operated. In the last case the machine will not reverse until 204 is by passed with momentary hold valve 217 being held until cam 170 moves off of lever 150 and allows valve 204 to be in its normally open position.

FIG. 14 is understood following the various connecting pipelines and the valves to which they are connected. Valves 200 thru 210 are 3 way valves normally closed with a spring connected to a mechanical lever. The top line connected to all these valves is the normally closed port, while the bottom line is connected to the normally open port and the horizontal line is connected to the common port. The lever arm that operates these valves is shown as a circle on FIG. 14, and for valves 204, 207 and 210 this lever is also shown on drawings 15 and 16 with numbers 150, 181, and 175 respectively. Valves 218 and 219 are the same type of 3 way valves, except in place of the lever and circle show a flat line indicating a push button for manual control. These valves can override 207 and 210 respectively. Line 230 indicates exhaust to atmosphere on the various valves.

Valves 212 thru 215 are 4-way pilot operated valves, with 215, 213, and 214 controlling the flow of air to the respective cylinders so that these cylinders operate continuously except when the air is cut off with another automatic valve. Four way valve 212 control the air flow to either cylinder 25 or cylinder 32 and therefore dictates whether the hose is being pulled off the reel and pushed into the tank, or the reel is being wound with the hose being pulled out of the tank. As explained above valves 207 and 210 automatically operate at the proper time of hose travel and then shift 4-way 212 accordingly. The solid lines thru the 4-way valves indicate one position, while the dotted lines indicate the flow when these valves are shifted to their other position. Oscillating cylinder 21 operates at all times when power is on, by a mechanical lever 310*a* attached to 310 trips first one of the 3-way valves 203 and then moving to the other end of the stroke and trips lever on 206. As 203 and 206 are operated alternately a pulse of air is directed to the respective pilots on 215 moving the flow thru this valve from the solid lines to the dotted lines and making piston rod 310 on cylinder 21 move back and forth.

Cylinders 25 and 32 are operated in the same manner, except they have an extra valve 202 for rod 309*a* trip to operate for proving that the pawl is past the disengaging point of the pawl 138 from pins 64; and an extra valve 208 for rod tripper 92*a* to operate when the rod is in the "in" position and the hose grip is free with rod 238 all the way extended. Only when lever on 202 is held can cylinder 32 operate, and only when lever on 208 is held can cylinder 25 operate. This protection automatically prevents the pawl from locking the reel as it moves in the direction opposite to wind; and prevents the grip from clamping the hose when the wind wheel is winding the hose onto the reel. Cylinder 81 is connected in parallel with cylinder 32 so that the hose grip is clamped when piston rod 92 moves out and thus pulls the hose off the reel.

When the hose has traveled all the way into the tank cam 173 on reel trips lever 181 on valve 207 sending an impulse to one of the pilots on 215 allowing air to flow thru 212 thru 208 and to 201 sending an impulse to the pilot on 213 reversing this 4-way valve so air will operate cylinder 25 and move rod 309 in until trip 309*a* moves lever on 200 and sends a pulse to pilot on 213 reversing the air flow to cylinder 25 and then continuing in this fashion to move rod 309 back and forth until cam 170 trips 175 and 150 to automatically shut off the machine.

What is claimed is:

1. A Tank cleaning machine comprising a housing, a hose, a nozzle manifold having one or more nozzles, means of connecting the nozzle manifold to the hose to allow the nozzle manifold to rotate or oscillate without the hose rotating, means to feed the nozzle manifold into and out of a tank being cleaned, means to supply pressurized liquid to the hose end opposite the nozzle manifold, means to control from outside the tank the rate of travel of the nozzle manifold into and out of the tank being cleaned, means to operate the rotation or oscillation of the nozzle manifold from outside the tank with or without liquid flowing, means to vary the degree of the oscillating arc and the speed of this oscillation as well as the speed of rotation if full rotation is desired of the nozzle manifold from outside the tank with or without liquid flowing, means to determine the direction and location of flow of the cleaning liquid from the nozzle, and thus know the area of the tank being cleaned by simply observing the mechanism of the cleaning machine that is outside the tank.

2. A tank cleaning machine of claim 1 including a track, means to mount the track inside a tank either permanently or means to easily remove the track and move to another tank with or without having the track telescopic.

3. A tank cleaning machine of claim 2 including a track bearing and a bearing housing at each end of track, means to attach and seal the entrance end bearing housing thru which the nozzle manifold and the hose enters the tank so the tank can be pressurized when the tank cleaning machine is not operating and when the hose is fully retracted from the tank, means to support nozzle manifold and hose with the track while cleaning, means to control from outside the tank the rotation of the nozzle manifold.

4. A tank cleaning machine of claim 3 including a hose reel, a stationary fluid supply pipe, means to attach the supply pipe to the housing, means for fluid to flow from the supply pipe connection thru the hose supply connection and thru the hose and out the opposite end of the hose and thru the nozzle manifold and out the nozzles while the hose is fully wound or being fed or wound back onto the reel, means to pull or feed the nozzle manifold end of the hose from the reel in a longitudinal manner so that the hose always leaves the reel tangentially and at the same location or spot, with respect to the housing as the reel turns and to rewind in the same manner.

5. A tank cleaning machine of claim 4 including a hollow stationary center shaft for the reel which connects to the supply pipe and with the opposite end of the center shaft sealed and with an outlet hole in the circumference, means for the stationary center shaft to support the reel from the housing, means for a fluid to flow from the outlet hole to the supply end of the hose.

6. A tank cleaning machine of claim 5 including a fluid supply chamber with bearings sealed and riding on the center shaft, means to attach the supply chamber to the reel so the reel and supply chamber will rotate and move axially with the reel, means to connect the supply chamber to the supply end of the hose so a fluid will flow from the supply chamber into the hose.

7. A tank cleaning machine of claim 6 including a radial pipe connection from the supply chamber to the supply end of the hose, spokes to support the reel, a hub attached to the supply chamber, means to attach the spokes to the hub and to the reel.

8. A tank cleaning machine of claim 7 comprising fixed guides attached to the housing, a spiral worm or screw type flights attached and wound around the drum part of the reel with a pitch to be not less than the hose diameter plus the thickness of the flights, means for the hose to be wound between the flights on the drum part of the reel, means for the fixed guides to engage the flights so that as the reel rotates it is forced to move axially a distance of the flight pitch for each revolution of the reel in the manner a screw when rotated feeds axially thru a fixed nut.

9. A tank cleaning machine of claim 8 comprising a drive wheel for winding, a gripping device and a feed cylinder or a cable winch with a one way clutch, limit switches and cam operators, a wind cylinder and pawl, means to feed off the hose from reel, means to wind the hose all automatically and with all controls and operating devices to be air or fluid operated.

10. A tank cleaning machine of claim 2 including automatic controls and power operated motors or cylinders, means with one start signal to automatically feed or pull the nozzle manifold into a tank and back out and to shut down at the end of one complete cycle or to continue to operate until again signaled all automatically.

11. A tank cleaning machine of claim 3 including automatic controls and power operated motors or cylinders, means with one start signal to automatically feed or pull the nozzle manifold into a tank and back out and to shut down at the end of one complete cycle or to continue to operate until again signaled all automatically.

12. A tank cleaning machine of claim 4 including automatic controls and power operated motors or cylinders, means with one start signal to automatically feed or pull the nozzle manifold into a tank and back out and to shut down at the end of one complete cycle or to continue to operate until again signaled all automatically.

13. A tank cleaning machine of claim 8 including automatic controls and power operated motors or cylinders, means with one start signal to automatically feed or pull the nozzle manifold into a tank and back out and to shut down at the end of one complete cycle or to continue to operate until again signaled all automatically.

14. A tank cleaning machine of claim 1 including automatic controls and power operated motors or cylinders, means with one start signal to automatically feed or pull the nozzle manifold into a tank and back out and to shut down at the end of one complete cycle or to continue to operate until again signaled all automatically.

* * * * *